US007299938B2

(12) United States Patent
Löble et al.

(10) Patent No.: US 7,299,938 B2
(45) Date of Patent: Nov. 27, 2007

(54) FREIGHT CONTAINER FOR AIR TRANSPORT

(75) Inventors: Albrecht Löble, Öhningen (DE); Gert Bretschneider, Hilzingen (DE); Ulf Hartmann, Hilzingen (DE)

(73) Assignee: Driessen Aircraft Interior Systems (Europe) B.V. (NL)

( * ) Notice: Subject to any disclaimer, the term of this patent is extended or adjusted under 35 U.S.C. 154(b) by 167 days.

(21) Appl. No.: 10/450,582

(22) PCT Filed: Dec. 6, 2001

(86) PCT No.: PCT/EP01/14329

§ 371 (c)(1),
(2), (4) Date: Jun. 13, 2003

(87) PCT Pub. No.: WO02/48009

PCT Pub. Date: Jun. 20, 2002

(65) Prior Publication Data

US 2004/0045959 A1 Mar. 11, 2004

(30) Foreign Application Priority Data

Dec. 13, 2000 (EP) ..... 00811188

(51) Int. Cl.
*B65D 88/00* (2006.01)

(52) U.S. Cl. ..... 220/1.5; 220/646

(58) Field of Classification Search ..... 220/1.5, 220/683, 688, 646; 296/182.1, 186.1
See application file for complete search history.

(56) References Cited

U.S. PATENT DOCUMENTS 4,222,606 A * 9/1980 Brown et al. ..... 296/186.1
4,325,488 A * 4/1982 Ketner ..... 220/1.5
4,403,804 A * 9/1983 Mountz et al. ..... 296/181.5
5,645,184 A 7/1997 Rowse et al.
6,112,931 A 9/2000 Booth et al.
6,237,793 B1 * 5/2001 Fingerhut et al. ..... 220/1.5

FOREIGN PATENT DOCUMENTS

| | | |
|---|---|---|
| EP | 0313601 | 5/1992 |
| JP | S40-91184 | 1/1968 |
| JP | S50-154327 | 12/1975 |
| WO | WO 93/22223 | * 11/1993 |

* cited by examiner

*Primary Examiner*—Anthony D Stashick
*Assistant Examiner*—Harry A Grosso
(74) *Attorney, Agent, or Firm*—Bachman & LaPointe, P.C.

(57) ABSTRACT

A freight container for air transport containing a floor element and a container structure, which is arranged on said floor element and which has lateral walls, a roof wall and a loading opening. The lateral walls and roof wall contain or are comprised of wall linings, which are composed of surface parts, in particular, of sheet metal elements. The loading opening is delimited up to the adjacent wall faces by terminating longitudinal edges. Two wall faces that abut against one another at an angle form a longitudinal edge. One or more longitudinal edges and/or terminating longitudinal edges of the container structure contain a reinforcing structure, whereby the reinforcing structure contains or is comprised of one or more surface parts, which can be reshaped once or a number of times and which are joined via joining zones in order to form the reinforcing structure. The reinforcing structure comprises a least one closed, channel-like hollow chamber extending in the direction of the longitudinal edge and is joined to the wall reinforcement via joining zones.

55 Claims, 4 Drawing Sheets

FREIGHT CONTAINER FOR AIR TRANSPORT

BACKGROUND OF THE INVENTION

The invention relates to a freight container for air transportation according to the preamble of claim 1. A method for the production thereof is also within the scope of the invention.

Freight containers for air transportation, hereinafter called airfreight containers, are used for storing and transportation of goods by aeroplane. Goods of this type may, for example, be fragile or easily perishable goods or luggage.

Airfreight containers are generally adapted to the inner wall structures of the cargo space for reasons of space and can therefore adopt various spatial shapes. Apart from right-parallelepiped shapes the airfreight containers may form one or two-sided so-called balcony structures which are used for the adaptation of the container shape to the arched wall of the aeroplane fuselage for the purpose of optimum use of the cargo space.

Known airfreight containers are constructed from a support framework made of profiled struts and covered with metal sheets or with infilling. The profiled struts in the process take on the supporting and stiffening function for the airfreight container. The profiled struts are generally open or closed extruded structural sections. The sheet metal coverings are generally attached by riveting to the support framework.

A current type of airfreight container of said type is, for example, disclosed in EP 0 313 601. The described airfreight container is a straight-surfaced bordered body. It consists of a base plate and a support framework placed thereon comprising vertical side sections and horizontal top sections, wherein, on one side the side sections towards the base are inclined towards the container interior and border an oblique lower wall face. In this generally known embodiment a container balcony formed on the airfreight container is referred to. The sections are closed extruded structural sections. Webs are also formed on the sections to which the sheet metal infills for the wall faces are applied by means of riveting.

The production of airfreight containers is very complex and expensive as the most varied parts, such as individual sections, sheet metal infills or gusset plates, have to be produced, machined and assembled into a complete airfreight container. For this purpose, the sectioned struts have to be assembled in first steps into a support framework and then the sheet metal lining has to be attached to the support framework The production of extruded structural sections, in particular extruded structural sections with closed cavities, is also complex and expensive.

U.S. Pat. No. 5,645,184 also describes a freight container for air transportation comprising expandable regions which could absorb the explosion energy of an explosion triggered in the freight container. The expandable structures relate to wave-shaped or harmonica-shaped layers in the wall regions which are stretched under the pressure of explosion. The expandable structures may be connected to one another in the corner regions by angled, flat corner elements.

U.S. Pat. No. 6,112,931 describes a freight container for air transportation which is also designed for the absorption of explosion energy. The wall regions also comprise wavy, expandable reinforcing layers. The wall elements are connected to one another in the corner regions by corner connections made of a fibre-reinforced plastics material.

It is the object of the invention to provide a self-supporting freight container for air transportation with a low weight and high stability, of which the individual components can be prefabricated simply and economically and with as little complexity as possible, and assembled.

SUMMARY OF THE INVENTION

The object is achieved by providing a container structure which is expediently a straight-surfaced bordered body and consists of plane wall faces, wherein two respective adjacent wall faces abut one another at an angle with the formation of a longitudinal edge. The container structure comprises a top wall, a rear and front side wall, the loading aperture preferably being provided in the front side wall, and an inner and outer side wall. Said walls in the process form the mentioned wall faces. The longitudinal edges at which the side walls abut one another are, with the exception of the longitudinal edges at the wall face of a balcony formation, inclined obliquely inwardly, suitably vertical longitudinal edges. The longitudinal edges at which the top wall abuts the side wall, are suitably horizontal longitudinal edges.

The container structure may also comprise two or more lateral loading apertures. The container structure may in particular contain two loading apertures, the first loading apertures being arranged in the front side wall and the second in the rear side wall. The front and rear side wall may be formed in a mirror-inverted manner in this embodiment.

The container structure may be right-parallelepiped or form a so-called container balcony at the outer and inner side wall. The container balcony is distinguished by a two-part side wall with an upper wall face and a lower wall face adjoining the upper wall face, the upper wall face having a vertical orientation and the lower wall face being inclined obliquely to the base element and towards the container interior. The lower side wall with the base element and the upper wall face encloses an obtuse angle in each case.

In container structures with a container balcony arranged on one side, the outer side wall is the container side formed in a balcony-like manner and facing the cargo space or internal aeroplane wall, while the inner side wall is the container side facing the cargo space interior and without a balcony formation.

Meant by surface parts are in particular flat, board-shaped or band-shaped parts. The surface parts of the wall lining and/or the reinforcement structure are preferably sheet metal elements or sheet metal parts. The surface parts of the wall lining and/or the reinforcement structure consist suitably of metal and preferably of aluminium or an aluminium alloy. The surface parts of the wall lining and/or the reinforcement structure may be made of a ferrous metal, such as iron, galvanised iron, steel, a non-ferrous metal or magnesium or a magnesium alloy. Included in the term sheet metal, sheet metal element or sheet metal part are in particular rolled products made of metal in the form of level, flat boards or bands. The thickness of the sheet metal elements is preferably between 0 mm and 10 mm, preferably between 0.4 mm and 5 mm and in particular between 0.6 mm and 1.5 mm.

The top wall and the side walls are, with the exception of the loading aperture, suitably lined with or consist of surface parts, in particular sheet metal elements, wherein the surface parts preferably have surface portions bordered over a straight area at least in the wall face. The wall linings preferably consist of aluminium or an aluminium alloy.

Arranged on the front side wall of the container structure, and optionally on the front and rear side wall is suitably a lateral loading aperture which is bordered by two vertical and one horizontal, top end longitudinal edge of the adjoining wall faces.

The reinforcement structures according to the invention may be provided on individual or all longitudinal and/or end longitudinal edges. The reinforcement structures according to the invention are preferably provided at least on one or more or all vertically oriented longitudinal edges. The reinforcement structures according to the invention are also provided on the vertical end longitudinal edges and in particular on the two vertical and the horizontal, top end longitudinal edges of the loading aperture.

The surface part or parts of the reinforcement structure are suitably connected to one another and to the wall lining by way of joining zones. The joining zones are preferably flat joining zones, in which surfaces portions of the surface parts forming the reinforcement structure with their large-area sides abut one another and/or the large-area sides of surface portions of the adjoining wall lining with the formation of a type of overlapping region.

The surface parts of the reinforcement structure are joined to the reinforcement structure preferably by means of riveting, such as tension-shear riveting, screwing, clinching, gluing and/or welding and/or connected to the adjoining wall linings.

To produce the connection between the individual surface parts connecting elements in general can be used, in other words aids for joining two components, such as adhesives, rivets, in particular tension-shear rivets, screws, clinches or welds.

The reinforcement structure preferably consists completely of shaped surface parts, in particular of shaped sheet metal elements and connecting elements. In a preferred embodiment, one or more, and in particular two, shaped surface parts form a reinforcement structure with at least one closed, channel-like cavity, preferably at least one of these closed channel-like cavities of the reinforcement structure extends over the entire longitudinal edge and extends substantially parallel to the longitudinal edge direction. The channel-like cavities of the reinforcement structure may also extend over one or more sections of the longitudinal edge and substantially parallel to the longitudinal edge direction.

The reinforcement structure suitably forms a bulge-like expanse and preferably has an overall width measured orthogonally to the adjacent wall face plane, which is greater than the thickness of the wall lining by a factor of 2, preferably a factor of 5 and in particular a factor of 10.

The reinforcement structure may also have two or more closed, channel-like cavities. Furthermore, two or more of said cavities may extend over the entire longitudinal edge substantially parallel to the longitudinal edge direction.

In a preferred embodiment at least one surface part of the reinforcement structure forms an open, groove-like hollow space or a closed, channel-like cavity. Said hollow space or cavity extends preferably over the entire longitudinal edge and extends substantially parallel to the longitudinal edge direction. Said surface part with an open hollow space with one or more further surface parts of the reinforcement structure suitably forms a closed cavity. The open, groove-like hollow space of said surface part may, for example have a U, V, C or Z cross-section. The open, groove-like hollow space may in particular have undercuts. Moreover, a plurality of open, groove-like hollow spaces extending in parallel or lying at an angle to one another may be formed in a surface part.

The surface part may in particular have beading, i.e. groove-like recesses, the depth of the groove being small relative to its length. The beading may be semi-circular beading, box beading, trapezoidal beading, triangular beading, multiple beading. Furthermore, closed or open beading may be provided. The beading may be mutually parallel as multiple beading or beading formed as groups of beading lying at an angle to one another. Because of the beading, the resistance of a metal sheet to elastic and plastic shape changes in the event of bending and torsional stress is increased by the increase in the moment of inertia or resistance. The stiffening effect of a beading depends on the predetermined sheet metal material and in the case of predetermined cross-sectional shape and metal sheet thickness, predominantly on the beading depth. Said surface part with beading forms a plurality of closed cavities, preferably with one or more further surface parts of the reinforcement structure.

The reinforcement structure, in particular of the vertical longitudinal edges and the end longitudinal edges, suitably consists of one or more external surface parts, i.e. remote from the container interior, forming an outer structural wall and one or more internal surface parts facing the container content, forming an inner structure wall.

The external surface part (or parts) of the reinforcement structure forming the outer structural wall is preferably a sheet metal element shaped in a section-like manner from a sheet metal strip or a plastic part, for example a fibre-reinforced plastic part.

The external surface part (or parts) of the reinforcement structure, which is not a part of the wall lining, preferably has a greater thickness than the internal surface part (or parts), which may be a part of the wall lining, all the surface parts consisting of sheet metal elements. The external surface part (or parts) may for example have a thickness which is greater by 5 to 100%, preferably 10 to 50%, than the internal surface part (or parts).

Preferably, at least one of the surface parts, as a part of the reinforcement structure, simultaneously forms the wall lining. Said surface part for this purpose is shaped at its edge-side end portion surface facing the longitudinal edge and forms with this end portion surface a part of the reinforcement structure. The surface part simultaneously forming the wall lining preferably forms the, or an, internal surface part or the inner structural wall of the reinforcement structure.

In a first embodiment of the invention, two shaped surface parts, in particular sheet metal elements, are joined to form a stiffening structure with the formation of at least one closed cavity, one of the surface parts simultaneously forming the wall lining and being shaped at a lateral end portion surface into a part of the stiffening structure. The surface part of the reinforcement structure simultaneously forming the wall lining preferably forms the inner structural wall. The individual surface parts of the reinforcement structure are connected to one another and/or to the wall linings, by way of flat joining zones.

In a further embodiment of the invention the surface part of a first wall lining with an end portion surface at the longitudinal edge is shaped towards the adjacent second wall face and joined to the wall lining of the second wall face. The wall lining may also be shaped with the two end portion surfaces on the corresponding longitudinal edge towards the adjacent wall face and be joined to the adjacent wall lining. An external shaped surface part is placed on the outside on the longitudinal edge with the formation of at least one closed channel-like cavity extending in the longitudinal edge direction. The external surface part is joined to the end portion surface of the first wall lining or to the end portion surfaces of the first and second wall lining.

In a further embodiment of the invention two shaped surface parts, in particular sheet metal elements, are joined to form a section-like reinforcement structure with the formation of at least one closed, channel-like cavity. The two surface parts preferably form, towards the two wall faces, a flat joining zone in the form of a longitudinal web, in which the two surface parts mutually abut with their end portion surfaces. The wall lining is attached by riveting to the web-like joining zones. The wall lining consists of sheet metal plates.

The surface parts of the reinforcement structure according to the invention, in particular the surface parts as sheet metal elements, are preferably shaped by means of a bending method, such as free bending, edging, edging pressing, folding or edge rolling or by means of roll forming. Moreover, the surface parts can also be shaped by means of a deep-drawing method, stretching forming, extruding or by means of roll bending. Combinations of the above-mentioned forming methods are conceivable.

The reinforcement structures may also comprise webs, ribs or flanges and recesses or indents, for example for receiving functional elements.

The reinforcement structures substantially take on the function of the previously used extruded cavity sections. The reinforcement structures, as a part of the container structure, preferably have a hollow section-like structure.

To reinforce the container structure, gusset or connecting elements can be used, preferably as sheet metal elements, at the longitudinal edges, and in particular in the corner regions of the longitudinal edges. In particular, the container structure can be connected to the base element, inter alia by means of gusset and connecting plates. The gusset plates are expediently made of ferrous metals, such as iron, galvanised iron, steel, non-ferrous metals such as brass, copper, magnesium and its alloys and preferably of aluminium or its alloys. The gusset plates are preferably installed by rivets, in particular by means of tension-shear rivets, into the structure. The gusset or connecting elements may also consist of plastics materials, suitably of reinforced, in particular fibre-reinforced plastics materials, preferably of carbon or glass fibre-reinforced plastics or of composite materials, in particular of metal-plastic composite materials.

The container structure without doors and closure systems consists in a preferred embodiment of the invention completely of sheet metal elements and connecting elements, in other words the container structure contains in particular no extruded structural sections. However, extruded structural sections can also be used at points and for local reinforcement in the container structure constructed substantially of sheet metal elements.

The container structure may also comprise differently formed reinforcement structures at the longitudinal and/or end longitudinal edges.

The loading aperture of the container structure suitably comprises a container door. The container door may, for example, be a flexible door or door tarpaulin which can be rolled up or pivoted in the vertical direction, as described in EP 0 533 626. Doors which can be rolled up can be fastened, for example at their top end, by way of piping sections to the reinforcement structure of the horizontal, top external longitudinal edge and at their base end laterally by way of locking devices or by way of horizontally arranged belts at the laterally abutting, vertical reinforcement structure of the outer longitudinal edges.

In a further variation, the container door is equipped with a so-called Barless closure, as described, for example in EP 1 061 009, in particular in FIG. 5*a* to *c* and the associated figure description. Horizontally extending closure belts are attached to a door tarpaulin. The closure belts may, for example, be sewn onto the door tarpaulin. The closure belts are pulled by their extended ends through loops at the lateral reinforcement structures of the vertical outer longitudinal edges. By tightening the belts the door tarpaulin is tensioned, wherein the belt portions of the extended belt ends guided through the loops are turned back and fixed on the door tarpaulin by the burr or Velcro® closure principle to the belt portion located therebelow. Attached at the base end of the door tarpaulin is a closure belt which is also guided with its extended ends through loops on the lateral reinforcement structures of the vertical outer longitudinal edges and as described above, pulled tight and fixed. The base closure belt may also be hooked at its ends by means of hook elements attached there to the loop and then pulled tight by means of belt tensioners, so the tarpaulin is tensioned. In this variation of a Barless closure no closure devices, such as snap closures or latch closures let into the reinforcement structure or attached thereto, are necessary. The loops may, for example be U-shaped elements with lateral connecting faces or webs made of metal or plastics material fastened to the reinforcement structure by riveting, screwing or gluing. The door tarpaulin at its top closure is expediently let into a piping groove of a hinge section attached by means of riveting to the reinforcement structure of the top outer longitudinal edge.

The wall lining, in particular the wall lining which is not a component of the reinforcement structure, may also be made out of textile fabrics, in particular of textile woven fabrics or of plastic elements, in particular of fibre-reinforced plastic elements or of composite materials, in particular of metal-plastic composite materials.

In the joining zones of the reinforcement structure sealing elements, for example in the form of sealing strips, can be provided. The sealing elements advantageously consist of plastics material, preferably of an elastomer or polyvinyl chloride (PVC) and are introduced for example by gluing in the joining zone.

The base element may be a conventional base element corresponding to the prior art, designed either as a base element for transportation by wheeled truck or as a base element for transportation by fork-lift trucks. In the latter case, the base element comprises so-called pockets or channels, which are provided for receiving the forks or prongs of the fork-lift truck.

The invention also relates to a method for producing an airfreight container which is distinguished in that the wall linings and the surface parts of the reinforcement structure are cut to size into sheet metal elements from rolled sheets and are bent in bending machines into structures intended for the purpose, and the preformed sheet metal elements are joined together as wall linings and surface parts of the reinforcement structures by means of connecting elements, such as rivets or adhesive, into a container structure with reinforcement structures.

The airfreight container according to the invention may have the conventional and common measurements and dimensions for airfreight containers and with respect to the shape, the size, the conditions for aviation approval and handling is comparable to conventional standard airfreight containers. The airfreight container according to the invention is equal to known standard airfreight containers with respect to strength, stability, quality, service life, maintenance requirement and repairability. The airfreight container according to the invention needs no, or substantially less, expensive extruded structural sections to achieve the necessary stability than conventional airfreight containers. The process procedures are substantially simplified and costs saved by the production of the airfreight containers from substantially shaped, in particular bent, sheet metal elements. The airfreight container according to the invention is up to 20% lighter compared to comparable airfreight containers according to the prior art.

BRIEF DESCRIPTION OF THE DRAWINGS

The invention will be described in more detail hereinafter with reference to examples and with the aid of the accompanying drawings, in which.

DETAILED DESCRIPTION

Figure 1:
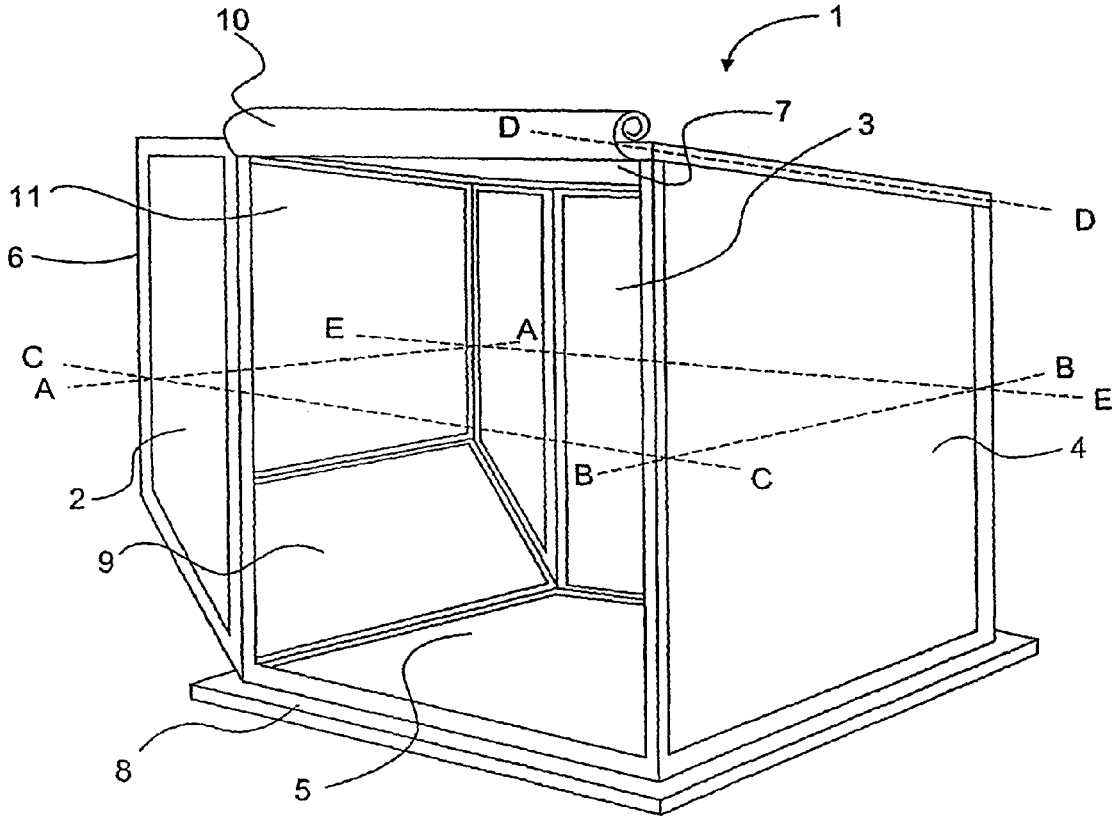
FIG. 1 shows a schematic view of an airfreight container with a balcony.

Arranged on a base element 8 is a container structure 1 with a rear side wall 3, a front side wall 2, an inner side wall 4, an outer side wall 6 and a top wall 7 (FIG. 1). Formed on the outer side wall 6 is a balcony structure with an upper wall face 11 and a lower wall face 9 inclined obliquely to the container interior and toward the base element 8. The front side wall 2 also comprises a loading aperture 5 which can be closed by a rollable container door 10.

Figure 2A:
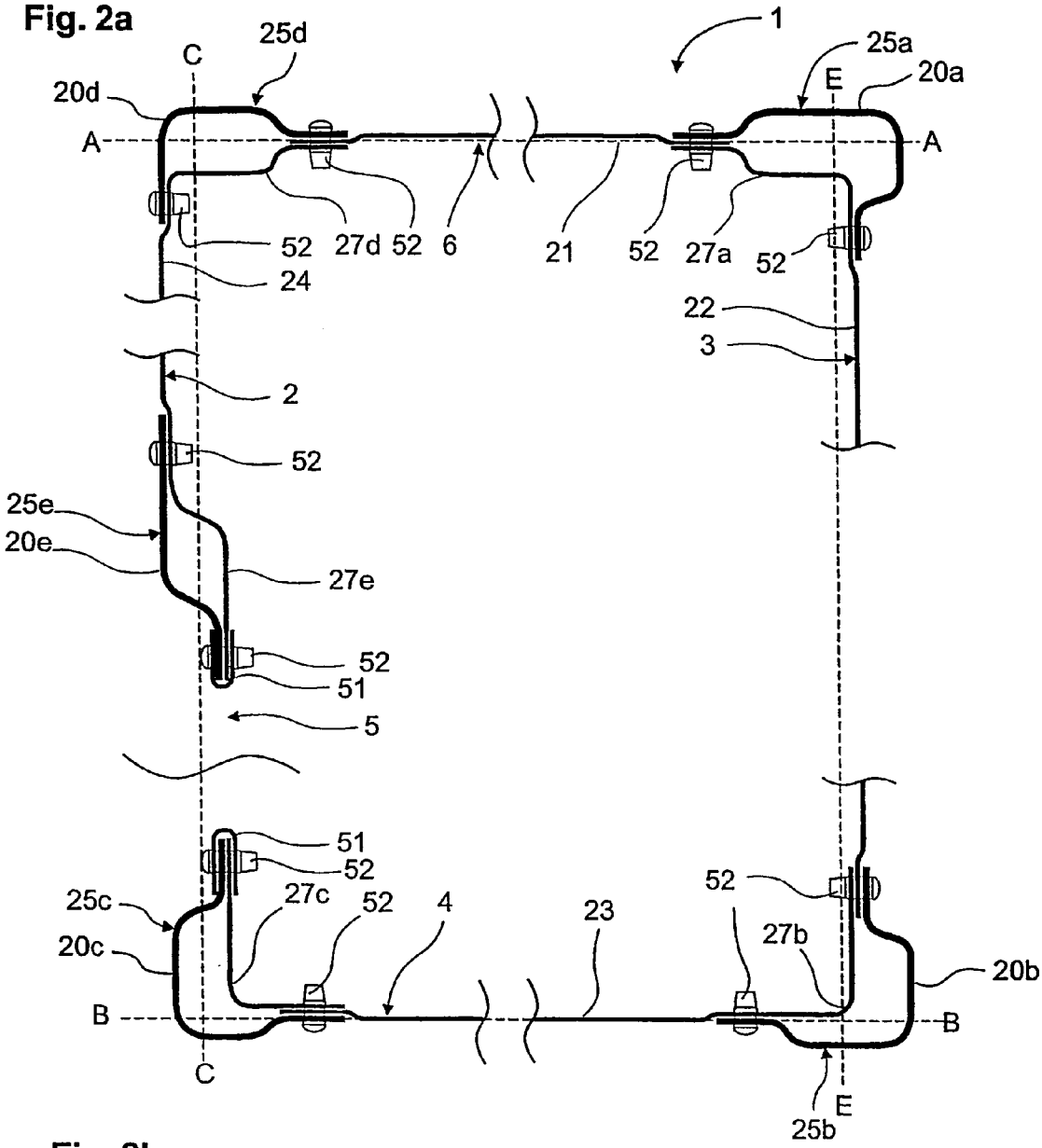
FIG. 2*a* shows a cross-sectional view of the vertical longitudinal edges of an airfreight container along the section lines A-A, B-B, C-C and E-E.

FIG. 2*a* shows a horizontal area section through the container structure 1 according to FIG. 1. The container structure 1 comprises in total five vertically oriented reinforcement structures 25*a, b, c, d, e* of which four reinforcement structures 25*a, b, c, d* are each arranged at the longitudinal edges between the individual side walls 2, 3, 4, 6. Two reinforcement structures 25*c, e* form the two vertical outer longitudinal edges of the loading aperture 5. The reinforcement structures 25*a, b, c, d, e* each consist of an external surface part forming an outer structural wall 20*a, b, c, d, e* and an internal surface part forming an inner structural wall. The same reference numerals are used, in each case, to designate the structural wall and the surface parts. The structural walls are formed from sheet metal elements, which are assembled by prior bending and mutual joining into said reinforcement structure 25*a, b, c, d, e*. The outer and inner structural walls together enclose a closed, channel-like cavity extending in the longitudinal edge direction. The outer, structural wall 20*a, b, c, d, e* which is exposed to high stress is formed from a sheet metal strip and has a greater thickness compared to the inner structural wall 27*a, b, c, d, e*, so the reinforcement structure is provided with greater stability. The two structural walls form flat joining zones towards each side wall 2, 3, 4, 6 or towards the loading aperture 5, to which joining zones the wall linings 24, 22, 23, 21 of the side walls 2, 3, 4, 6 are joined. The sheet metal elements of the reinforcement structure 25*a, b, c, d, e* are also mutually joined at the flat joining zones. The connections are effected by means of riveting 52. The wall linings 24, 22, 23, 21 consist of sheet metal elements. Both the sheet metal elements of the structural walls and the wall linings are made of aluminium or an aluminium alloy.

The section line A-A shows the horizontal section through the upper wall face 11 of the outer side wall 6 according to FIG. 1. A respective reinforcement structure 25*a, d* is arranged at the longitudinal edges between the outer side wall 6 and the rear side wall 3 or the front side wall 2. The inner structural walls 27*a, d* of the two reinforcement structures 25*a, d* are formed from the extended end portion surfaces of the rear or front wall lining 22, 24 and bent by way of the longitudinal edge into the adjacent wall face. The two external sheet metal elements of the outer structural walls 20*a, d* are also bent by way of the longitudinal edge into the adjacent wall faces. The wall lining 21 of the outer side wall 6 is inserted in the region of the joining zones between the respective outer and inner structural wall of the two reinforcement structures 25*a, d* and joined to the reinforcement structure 25*a, d* by means of riveting 52.

The section line B-B shows the horizontal section though the inner side wall 4. Arranged at the longitudinal edges between the inner side wall 4 and the rear side wall 3 or the front side wall 2 is a further respective reinforcement structure 25*b, c*. The inner structural wall 27*b* of the reinforcement structure 20*b* to the rear side wall 3 is formed from an extended end portion surface of the inner wall lining 23 which is bent by way of the longitudinal edge into the adjacent wall face. The rear wall lining 22 is pushed at the joining zone to the reinforcement structure 25*b* between the inner and outer structural wall 27*b*, 20*b* and connected to the reinforcement structure 25*b* by means of riveting 52. The reinforcement structure 25*c* arranged at the front side wall 2 forms a first vertical outer longitudinal edge of the loading aperture 5. The inner structural wall 27*c* is made of a bent sheet metal strip. The two structural walls 20*c*, 27*c* form flat joining zones towards the inner side wall and towards the loading aperture 5, at which the sheet metal elements 20*c*, 27*c* are joined by means of riveting 52. The inner wall lining 23 is pushed at the door-side reinforcement structure 25*c* into the joining zone between the external and internal structural wall 20*c*, 27*c* and is joined by means of riveting 52 to the reinforcement structure 25*c*. An edge protection 51 is also attached by way of the door-side joining zone, which edge protection 51 is joined together with the sheet metal elements 20*c*, 27*c* by means of riveting 52. The sheet metal element of the outer structural wall 20*b, c* of the two reinforcement structures 25*b, c* is bent by way of the respective longitudinal edge into the adjacent wall faces.

Arranged on the other side of the loading aperture 5 is a second reinforcement structure 25*e* which forms a further vertical outer longitudinal edge of the loading aperture 5 (section line C-C). The front wall lining 24 forms with its two extended end portion surfaces the inner structural wall 27*e, d* of the two reinforcement structures 20*e, d*, the end portion surface directed to the outer side wall 6 being bent by way of the longitudinal edge into the outer side wall 6. The inner and outer structural walls form flat joining zones towards the adjacent wall faces or towards the loading aperture, at which zones the sheet metal elements of the structural walls are mutually joined by means of riveting 52. An edge protection 51 is also attached by way of the door-side joining zone of the second reinforcement structure 25*e*, which edge protection 51 is joined together with the two structural walls 20*e*, 27*e* by means of riveting 52.

The section line E-E shows the horizontal section through the rear side wall 3. Arranged at the longitudinal edges between the rear side wall 3 and the outer side wall 6 or the inner side wall 4 is a respective reinforcement structure 25*a, b*, with a structure described above.

Figure 2B:
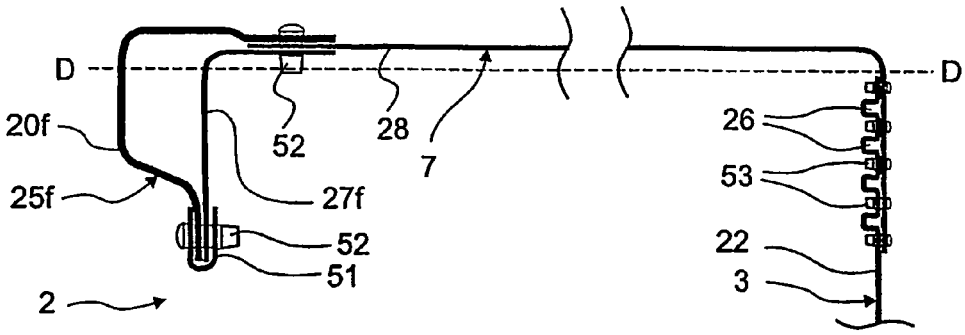
FIG. 2*b* shows a cross-sectional view through the top wall of an airfreight container along the section line D-D.

The section line D-D shows the horizontal section through the top wall 7 according to FIG. 1 (see FIG. 2*b*). Arranged towards the front side wall 2 is a horizontal reinforcement structure 25*f* which in the region of the loading aperture 5 forms the upper horizontal outer longitudinal edge.

The horizontal reinforcement structure 25*f* consists of an outer and an inner structural wall 20*f*, 27*f*, the outer structural wall 20*f* having a greater thickness than the inner structural wall 27*f*. The inner structural wall 27*f* is formed from the extended end portion surface of the top wall lining 28 and is bent by way of the outer longitudinal edge into the front side wall 2. The outer structural wall 20*f* is also bent by way of the longitudinal edge. The two structural walls 20*f*, 27*f* form flat joining zones towards the front side wall 2 and the top wall 7, at which joining zones the sheet metal elements of the structural walls are joined together by means of riveting 52. The top wall lining 28 is pushed at the joining zone between the outer and inner structural wall 20*f*, 20*f* and joined to the reinforcement structure 25*c* by means of riveting 52. An edge protection 51 is attached to the joining zone pointing to the loading aperture 5, the edge protection 51 being joined by means of riveting 52, in particular by means of tension-shear rivets, to the reinforcement structure.

The top wall lining 28, towards the rear, the outer and the inner side wall 3, 6, 4, has a respective end portion surface which is angled by way of the horizontal longitudinal edges into the corresponding side wall 3, 6, 4. The angled end portion surfaces have horizontally extending reinforcement grooves in the form of beading 26. The angled end portion surfaces with the corresponding side wall linings 21, 22, 23 form joining zones in the form of overlapping regions, at which the top wall lining is joined to the corresponding side wall linings 21, 22, 23 by way of riveting 53.

Figure 3:
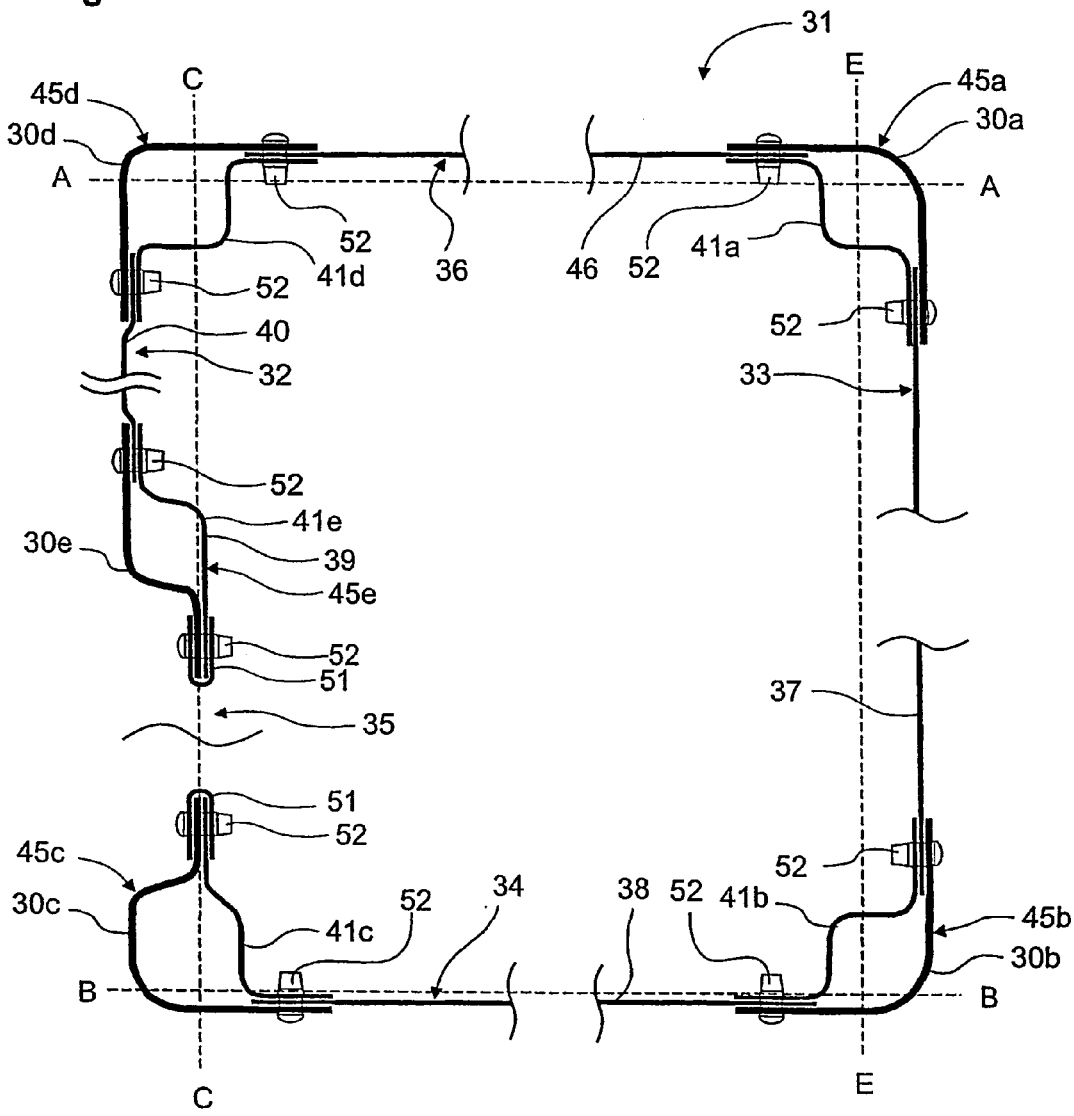
FIG. 3 shows a cross-sectional view of the vertical longitudinal edges of a further airfreight container.

FIG. 3 shows a horizontal area section through a container structure of a further embodiment variation according to FIG. 1. The container structure comprises a total of five vertically directed reinforcement structures 45*a, b, c, d, e* of which four reinforcement structures 45*a, b, c, d* are each arranged at the longitudinal edges between the individual side walls 32, 33, 34, 36. Two reinforcement structures 45*c, e* form the two vertical outer longitudinal edges of the loading aperture 35. The reinforcement structures 45*a, b, c, d, e* each consist of an external surface part forming an outer structural wall 30*a, b, c, d, e* and an internal surface part forming an inner structural wall 41*a, b, c, d, e*. The same reference numerals are used in each case to designate the structural wall and the surface parts. The structural walls are formed from sheet metal elements formed by prior bending and mutual joining to said reinforcement structure 45*a, b, c, d, e*. The outer and inner structural wall in the process together enclose a channel-like cavity extending in the longitudinal direction. Both the outer and the inner structural wall are formed from a respective sheet metal strip bent by way of the longitudinal edge into the adjacent wall faces. The two structural walls form a flat joining zone towards each side wall 32, 33, 34, 36 or towards the loading aperture 35, at which joining zones the structural walls are joined to one another and to the adjacent wall linings by means of riveting 52. The outer structural wall 30*a, b, c, d, e* which is exposed to higher stress has a greater thickness relative to the inner structural wall 41*a, b, c, d, e*, so the reinforcement structure is provided with higher stability. The wall linings of the side walls 2, 3, 4, 6 consist of sheet metal elements. Both the sheet metal elements of the structural walls and also the wall linings are made of aluminium or an aluminium alloy.

The section line A-A shows the horizontal section through the upper wall face 11 of the outer side wall 6 according to FIG. 1. Arranged at the longitudinal edges between the outer side wall 36 and the rear side wall 33 or the front side wall 32 are two reinforcement structures 45*a, d*. The inner structural wall 41*a, d* and the outer structural wall 30*a, d* of the two reinforcement structures 45*a, d* are bent by way of the longitudinal edge into the adjacent wall faces. The wall lining 46 of the outer side wall 36 in the region of the joining zones is inserted between the respective outer and inner structural wall of the two reinforcement structures 45*a, d* and joined to the reinforcement structure 45*a, d* by means of riveting 52, in particular by means of tension-shear rivets, to the reinforcement structure 45*a, d*.

The section line B-B shows the horizontal section through the inner side wall 4 according to FIG. 1. Arranged at the longitudinal edges between the inner side wall 34 and the rear side wall 33 or the front side wall 32 is a respective reinforcement structure 45*b, c*. The inner structural wall 41*b, c* and the outer structural wall 30*b, c* of the two reinforcement structures 45*b, c* are bent by way of the longitudinal edge into the adjacent wall faces. The rear wall lining 37 at the joining zone is pushed to the rear reinforcement structure 45*a, b* between the inner and outer structural wall and joined to the reinforcement structure 45*a, b* by means of riveting 52. The wall lining 38 of the inner side wall 34 in the region of the joining zones is inserted between the outer and inner respective structural wall of the two reinforcement structures 45*b, c* and joined to the reinforcement structures 45*b, c* by means of riveting 52.

The reinforcement structure 45*c* arranged towards the front side wall 32 forms a first vertical outer longitudinal edge of the loading aperture 35. The two outer and inner structural walls 30*c*, 41*c* form a flat joining zone towards the inner side wall 34 and the loading aperture 35, at which joining zones the sheet metal elements of the structural walls 30*c*, 41*c* are joined by means of riveting 52. An edge protection 51 is attached by way of the door-side joining zone by means of riveting 52.

Arranged on the other side of the loading aperture 35 is arranged a further reinforcement structure 45*e* forming the second vertical outer longitudinal edge of the loading aperture 35 (section line C-C). The inner and outer structural walls form flat joining zones towards the adjacent wall faces or the loading aperture, at which joining zones the sheet metal elements of the structural walls are joined to one another and to the adjacent wall linings by means of riveting 52. An edge protection 51 is also attached by way of the door-side joining zone of the second reinforcement structure 45*e*, which edge protection 51 is joined together with the two structural walls 30*e*, 41*e* by means of riveting 52.

The section line E-E shows the horizontal section through the rear side wall 33. Arranged at the longitudinal edges between the rear side wall 33 and the outer side wall 36 or the inner side wall 34 is a respective reinforcement structure 45*a, b*, with a structure described above.

The individual reinforcement structures according to FIGS. 1 and 2 may obviously also be used in any other combinations.

Figure 4:
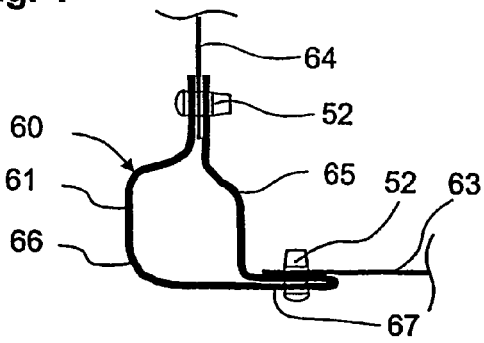
FIGS. 4 to 9 shows cross-sections through further reinforcement structures.

The reinforcement structure 60 of a further embodiment variation according to FIG. 4 consists of a sheet metal element 61 shaped into a hollow section by multiple bending, which forms both the outer and the inner structural wall 65, 66. The sheet metal element 61 forms a flat joining zone, to which the two end portion surfaces of the sheet metal element 61 and the adjacent first wall lining 64, pushed between the outer and inner structural wall 65, 66, is joined by riveting 52. The reinforcement structure 60 also forms a web 67 at which the second wall lining 63 is attached to the reinforcement structure by means of riveting 52. The wall linings 63, 64 consist of sheet metal elements. Both the sheet metal elements of the structural walls and the wall linings are made of aluminium or an aluminium alloy.

Figure 5:
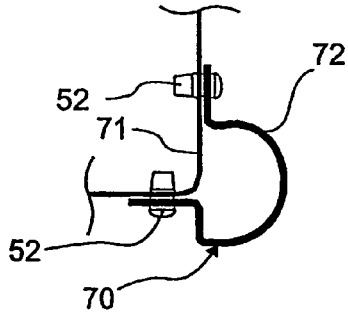

The reinforcement structure 70 of a further embodiment variation according to FIG. 5 consists of an inner and an outer structural wall 71, 72, which together enclose a closed channel-like cavity. The outer structural wall 72 consists of a sheet metal strip multiply shaped by bending. The inner structural wall 72 is formed from the wall lining 71. The two structural walls 71, 72 are joined together by way of joining zones by means of riveting 52. The wall lining 71 consists of a sheet metal element. Both the sheet metal elements of the structural walls and the wall lining are made of aluminium or an aluminium alloy.

The thickness of the individual sheet metal elements, in particular the thickness of the outer and inner structural wall in the above-mentioned embodiments from FIGS. 2 to 5 may also be uniform. The container structures according to FIGS. 2 and 3 can also be two opposing loading apertures provided in the front and rear side wall, wherein a container structure of this type would comprise six vertical reinforcement structures.

Figure 6:
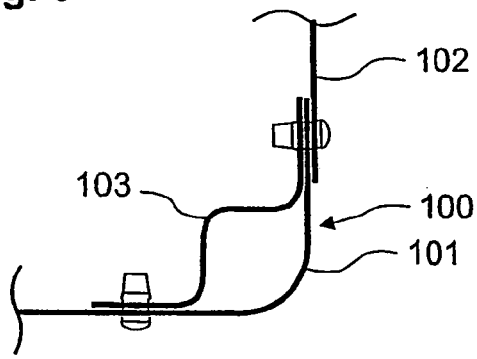

FIG. 6 shows a reinforcement structure 100 formed by a first wall lining 101 forming the outer structural wall and a surface element 103 forming the inner structural wall. The two structural walls are shaped accordingly with the formation of a hollow section-like reinforcement structure, the first wall lining 101 with its end portion surface being bent into the adjacent wall face. A second wall lining 102 adjoins the reinforcement structure 100 by way of a flat joining zone.

Figure 7:
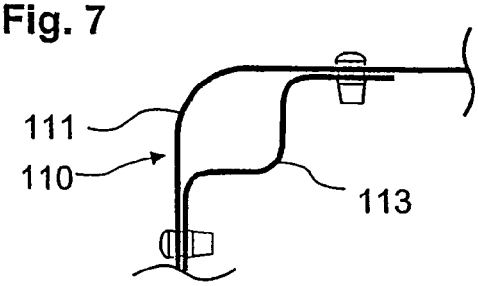

FIG. 7 shows a reinforcement structure formed by a top wall lining 111 forming the outer structural wall and a surface element 113 forming the inner structural wall. The two structural walls are shaped accordingly with the formation of a hollow section-like reinforcement structure, wherein the top wall lining 111 with its end portion surface is bent into the adjacent wall face.

Figure 8:
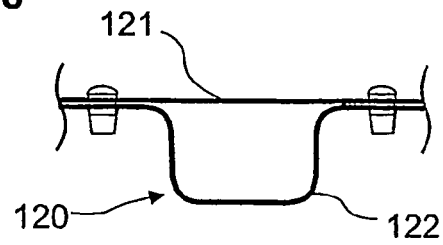
Figure 9:
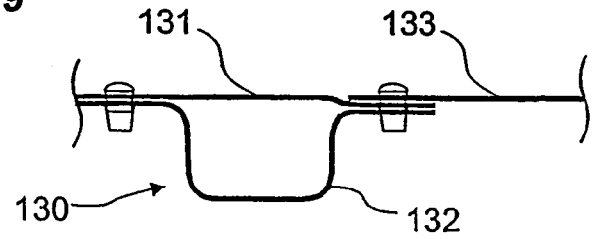

FIGS. 8 and 9 show reinforcement structures in a side wall face. The reinforcement structure 120 according to FIG. 8 shows a continuous wall lining 121 forming the outer structural wall and a surface element 122 forming the inner structural wall. The two structural walls are shaped accordingly with the formation of a hollow section-like reinforcement structure. FIG. 9 shows a side wall assembled from a first and a second wall lining 131, 133 in the region of a reinforcement structure 130. The reinforcement structure is formed by a first wall lining 131 forming the outer structural wall and a surface element 132 forming the inner structural wall. The two structural walls are shaped accordingly with the formation of a hollow section-like reinforcement structure. The second wall lining 133 adjoins the reinforcement structure 130 by way of a flat joining zone.

The reinforcement structures according to FIGS. 8 and 9 may also be used in the top wall face.

The invention claimed is:

1. A freight container comprises a base element, a top wall, and a plurality of side walls extending in a longitudinal direction between the base element and the top wall, and the top wall and side walls comprise wall linings made of sheet metal and are bordered by edges wherein at least one edge includes a reinforcing structure, the at least one edge is in the form of a corner wherein at least two walls selected from the group of side walls and top wall are connected at the corner of the container by the reinforcing structure, the reinforcing structure comprises at least one part wherein the at least one part is shaped and has at least one joining zone to define a hollow channel structure, the container comprises at least one loading aperture, and the at least one loading aperture is bordered by further edges of adjacent side walls and top wall, wherein at least one edge of the further edges comprises a further reinforcing structure, the further reinforcing structure having at least one further part, wherein the at least one further part is shaped and has at least one further joining zone to define a further hollow channel structure, wherein at least one of the reinforcing structures forms a bulge with respect to the wall linings, wherein the reinforcing structure and further reinforcing structure each comprise at least a first part and a second part connected to each other by joining zones which together define the hollow channel structures, and at least one joining zone is a flat joining zone and comprises end portions of the parts forming the reinforcement structure which abut one another, and an end portions of a wall lining with the formation of an overlapping region and the parts forming the reinforcement structure and the end portion of the wall lining are held by means of connecting elements.

2. A freight container according to claim 1, wherein the at least one bulge has a width dimension measured orthogonally to the adjacent wall lining, which is greater than the thickness of said wall lining.

3. A freight container according to claim 1, wherein the at least one bulge protrudes with respect to the at least one adjacent wall lining towards the exterior of the container.

4. A freight container according to claim 1, wherein the at least one bulge protrudes with respect to the at least one adjacent wall lining towards the interior of the container.

5. A freight container according to claim 1, wherein the reinforcing structures each have a hollow section-like structure which causes an increase in the moment of inertia or resistance and stiffening reinforcement of the edges to prevent elastic and plastic deformation in the event of bending and torsional stress.

6. A freight container according to claim 1, wherein the at least one part of the reinforcing structure is shaped by bending.

7. A freight container according to claim 1, wherein the container is for air transportation.

8. A freight container according to claim 1, wherein at least one part is a shaped metal sheet part.

9. A freight container according to claim 1, wherein the at least first and second part are shaped metal sheet parts.

10. A freight container according to claim 1, wherein the at least second part is a shaped metal extruded part.

11. A freight container according to claim 1, wherein the wall linings comprise sheet metal elements.

12. A freight container according to claim 8, wherein at least one part of the reinforcing structure is a shaped metal sheet part.

13. A freight container according to claim 1, wherein the at least one joining zone is a flat joining zone.

14. A freight container according to claim 1, wherein the reinforcing structure is connected to at least one of the wall linings selected from the group of side wall linings and top wall lining by connecting means.

15. A freight container according to claim 14, wherein the connecting means pass through both the at least one part of the reinforcement structure and the wall lining.

16. A freight container according to claim 1, wherein the at least one part of the reinforcing structure is an end portion of the wall lining.

17. A freight container according to claim 1, wherein the first part of the reinforcing structure is an end portion of the wall lining.

18. A freight container according to claim 1, wherein the first part of the reinforcing structure is an end portion of a first wall lining and the second part of the reinforcing structure is an end portion of a second wall lining.

19. A freight container according to claim 1, wherein the at least one part of the reinforcing structure forms a groove-like hollow space.

20. A freight container comprises a base element, a top wall, and a plurality of side walls extending in a longitudinal direction between the base element and the top wall, at least two of the top wall and plurality of side walls comprise sheet linings having edges wherein at least one of (1) the top wall and a side wall and (2) two side walls are connected at the edges by a reinforcing structure, the reinforcing structure comprises a first part and a second part connected to each other which together define a hollow channel structure, at least one of the first part and second part is a shaped metal sheet part, the reinforcing structure is connected to the sheet linings by connecting means, the connecting means pass through both the shaped metal sheet part and the sheet linings, the container further includes at least one loading aperture, wherein the at least one loading aperture is defined by opposed reinforcing structures each comprising a first part and a second part connected to each other which together define a hollow channel structure, wherein one of the opposed reinforcing structures comprises a corner reinforcing structure and the other opposed reinforcing structure comprises a portion of one of the sidewalls, wherein the reinforcing structure and opposed reinforcing structures each comprise at least the first part and the second part connected to each other by joining zones which together define the hollow channel structures, and at least one joining zone is a flat joining zone and comprises end portions of the parts forming the reinforcement structure which abut one another, and an end portions of a wall lining with the formation of an overlapping region and the parts forming the reinforcement structure and the end portion of the wall lining are held by means of connecting elements.

21. A freight container according to claim 20, wherein the sidewall comprises wall linings made of sheet metal and wherein the other of the first part and the second part comprises a portion of the sheet metal wall lining.

22. A freight container according to claim 20, wherein the other of the first and second part is a shaped metal extruded part.

23. A freight container according to claim 21, wherein the wall linings comprise sheet metal elements made of one of aluminum, aluminum alloy, and steel.

24. A freight container according to claim 20, wherein the at least one part of the reinforcement structure forms a groove-like hollow space.

25. A freight container according to claim 20, wherein the first part and the second part of the reinforcing structure are connected to one another by joining zones, and the joining zones comprise flat joining zones wherein end portions of the parts forming the reinforcement structure abut one another, and an end portion of a wall lining with the formation of an overlapping region.

26. A freight container according to claim 20, wherein the opposed reinforcing structure which comprises a portion of a side wall comprises a first and a second part which form flat joining zones with a side wall in a sandwich-like manner and are held by means of connecting elements.

27. Method for producing a freight container according to claim 1, wherein the wall linings and the at least one part of the reinforcing structure are cut to size into sheet metal elements from rolled sheets and bent in bending machines and the sheet metal elements forming the wall linings and the at least one part of the reinforcing structure are joined together.

28. Freight container for air transportation comprising a base element and a container structure arranged on the base element with side walls, a top wall and one or more loading apertures, wherein the side walls and top wall comprise wall linings made of sheet metal elements, and the side walls and top wall comprise wall faces, of which two wall faces abutting one another at an angle form a longitudinal edge, and the loading aperture is delimited by end longitudinal edges extending toward the longitudinal edges, and one or more longitudinal edges and/or end longitudinal edges in the container structure comprise a reinforcement structure, characterized in that the reinforcement structure comprises one or more surface parts shaped in the form of an outer and/or inner structural walls of the reinforcement structure, which are joined by way of joining zones to the wall linings of the container structure by means of connecting elements to integrate the side walls, the top wall and the surface parts into the container structure, and the reinforcement structure comprises at least one closed, channel-like cavity extending in the longitudinal or end longitudinal edge direction, which is defined by the outer and inner structural walls of the reinforcement structure, and the reinforcement structure comprises a hollow-section like structure which causes an increase in the moment of inertia or resistance and a stiffening reinforcement of the edges against elastic and plastic shape changes in the event of bending and torsional stress, wherein the reinforcement structures each comprise at least a first part and a second part connected to each other by joining zones which together define the hollow-section like structures, and at least one joining zone is a flat joining zone and comprises end portions of the parts forming the reinforcement structure which abut one another, and an end portions of a wall lining with the formation of an overlapping region and the parts forming the reinforcement structure and the end portion of the wall lining are held by means of connecting elements.

29. A freight container comprises a base element, a top wall, and a plurality of side walls extending in a longitudinal direction between the base element and the top wall, and the top wall and side walls comprise wall linings made of sheet metal and are bordered by edges wherein at least one edge includes a reinforcing structure, the at least one edge is in the form of a corner wherein at least two walls selected from the group of side walls and top wall are connected at the corner of the container by the reinforcing structure, the reinforcing structure comprises at least one part wherein the at least one part is shaped and has at least one joining zone to define a hollow channel structure, the container comprises at least one loading aperture, and the at least one loading aperture is bordered by further edges of adjacent side walls and top wall, wherein at least one edge of the further edges comprises a further reinforcing structure, the further reinforcing structure having at least one further part, wherein the at least one further part is shaped and has at least one further joining zone to define a further hollow channel structure, wherein at least one of the reinforcing structures forms a bulge with respect to the wall linings, wherein the reinforcing structure and further reinforcing structure each comprise at least a first part and a second part connected to each other by joining zones which together define the hollow channel structures, and at least one joining zone is a flat joining zone and comprises end portions of the parts forming the reinforcement structure and an end portion of a wall lining which is arranged between the end portions of the parts forming the reinforcement structure in a sandwich-like manner and the parts forming the reinforcement structure and the end portion of a wall lining are held by means of connecting elements.

30. A freight container according to claim 29, wherein the at least one bulge has a width dimension measured orthogonally to the adjacent wall lining, which is greater than the thickness of said wall lining.

31. A freight container according to claim 29, wherein the at least one bulge protrudes with respect to the at least one adjacent wall lining towards the exterior of the container.

32. A freight container according to claim 29, wherein the at least one bulge protrudes with respect to the at least one adjacent wall lining towards the interior of the container.

33. A freight container according to claim 29, wherein the reinforcing structures each have a hollow section-like structure which causes an increase in the moment of inertia or resistance and stiffening reinforcement of the edges to prevent elastic and plastic deformation in the event of bending and torsional stress.

34. A freight container according to claim 29, wherein the at least one part of the reinforcing structure is shaped by bending.

35. A freight container according to claim 29, wherein the container is for air transportation.

36. A freight container according to claim 29, wherein at least one part is a shaped metal sheet part.

37. A freight container according to claim 29, wherein the at least first and second part are shaped metal sheet parts.

38. A freight container according to claim 36, wherein the at least second part is a shaped metal extruded part.

39. A freight container according to claim 29, wherein the wall linings comprise sheet metal elements.

40. A freight container according to claim 36, wherein at least one part of the reinforcing structure is a shaped metal sheet part.

41. A freight container according to claim 36, wherein the at least one joining zone is a flat joining zone.

42. A freight container according to claim 36, wherein the reinforcing structure is connected to at least one of the wall linings selected from the group of side wall linings and top wall lining by connecting means.

43. A freight container according to claim 42, wherein the connecting means pass through both the at least one part of the reinforcement structure and the wall lining.

44. A freight container according to claim 29, wherein the at least one part of the reinforcing structure is an end portion of the wall lining.

45. A freight container according to claim 29, wherein the first part of the reinforcing structure is an end portion of the wall lining.

46. A freight container according to claim 29, wherein the first part of the reinforcing structure is an end portion of a first wall lining and the second part of the reinforcing structure is an end portion of a second wall lining.

47. A freight container according to claim 29, wherein the at least one part of the reinforcing structure forms a groove-like hollow space.

48. Method for producing a freight container according to claim 29, wherein the wall linings and the at least one part of the reinforcing structure are cut to size into sheet metal elements from rolled sheets and bent in bending machines and the sheet metal elements forming the wall linings and the at least one part of the reinforcing structure are joined together.

49. A freight container comprises a base element, a top wall, and a plurality of side walls extending in a longitudinal direction between the base element and the top wall, at least two of the top wall and plurality of side walls comprise sheet linings having edges wherein at least one of (1) the top wall and a side wall and (2) two side walls are connected at the edges by a reinforcing structure, the reinforcing structure comprises a first part and a second part connected to each other which together define a hollow channel structure, at least one of the first part and second part is a shaped metal sheet part, the reinforcing structure is connected to the sheet linings by connecting means, the connecting means pass through both the shaped metal sheet part and the sheet linings, the container further includes at least one loading aperture, wherein the at least one loading aperture is defined by opposed reinforcing structures each comprising a first part and a second part connected to each other which together define a hollow channel structure, wherein one of the opposed reinforcing structures comprises a corner reinforcing structure and the other opposed reinforcing structure comprises a portion of one of the sidewalls, wherein the reinforcing structure and opposed reinforcing structures each comprise at least the first part and the second part connected to each other by joining zones which together define the hollow channel structures, and at least one joining zone is a flat joining zone and comprises end portions of the parts forming the reinforcement structure and an end portion of a wall lining which is arranged between the end portions of the parts forming the reinforcement structure in a sandwich-like manner and the parts forming the reinforcement structure and the end portion of a wall lining are held by means of connecting elements.

50. A freight container according to claim 49, wherein the sidewall comprises wall linings made of sheet metal and wherein the other of the first part and the second part comprises a portion of the sheet metal wall lining.

51. A freight container according to claim 49, wherein the other of the first and second part is a shaped metal extruded part.

52. A freight container according to claim 50, wherein the wall linings comprise sheet metal elements made of one of aluminum, aluminum alloy, and steel.

53. A freight container according to claim 49, wherein the at least one part of the reinforcement structure forms a groove-like hollow space.

54. A freight container according to claim 49, wherein the first part and the second part of the reinforcing structure are connected to one another by joining zones, and the joining zones comprise flat joining zones wherein end portions of the parts forming the reinforcement structure abut one another, and an end portion of a wall lining with the formation of an overlapping region.

55. Freight container for air transportation comprising a base element and a container structure arranged on the base element with side walls, a top wall and one or more loading apertures, wherein the side walls and top wall comprise wall linings made of sheet metal elements, and the side walls and top wall comprise wall faces, of which two wall faces abutting one another at an angle form a longitudinal edge, and the loading aperture is delimited by end longitudinal edges extending toward the longitudinal edges, and one or more longitudinal edges and/or end longitudinal edges in the container structure comprise a reinforcement structure, characterized in that the reinforcement structure comprises one or more surface parts shaped in the form of an outer and/or inner structural walls of the reinforcement structure, which are joined by way of joining zones to the wall linings of the container structure by means of connecting elements to integrate the side walls, the top wall and the surface parts into the container structure, and the reinforcement structure comprises at least one closed, channel-like cavity extending in the longitudinal or end longitudinal edge direction, which is defined by the outer and inner structural walls of the reinforcement structure, and the reinforcement structure comprises a hollow-section like structure which causes an increase in the moment of inertia or resistance and a stiffening reinforcement of the edges against elastic and plastic shape changes in the event of bending and torsional stress, wherein the reinforcement structures each comprise at least a first part and a second part connected to each other by joining zones which together define the hollow-section like structures, and at least one joining zone is a flat joining zone and comprises end portions of the parts forming the reinforcement structure and an end portion of a wall lining which is arranged between the end portions of the parts forming the reinforcement structure in a sandwich-like manner and the parts forming the reinforcement structure and the end portion of a wall lining are held by means of connecting elements.

* * * * *